US006829789B1

(12) United States Patent
Liang

(10) Patent No.: US 6,829,789 B1
(45) Date of Patent: Dec. 14, 2004

(54) MASSAGING TUB HAVING AUTOMATIC WASHING FUNCTION

(76) Inventor: Ching-Yao Liang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/643,478

(22) Filed: Aug. 15, 2003

(51) Int. Cl.[7] ..... A47K 3/00
(52) U.S. Cl. ..... 4/541.1; 4/541.3; 601/156
(58) Field of Search ..... 4/541.1, 541.3, 4/541.4, 541.5, 492, 662; 601/156, 157, 158

(56) References Cited

U.S. PATENT DOCUMENTS 4,954,179 A * 9/1990 Franninge ..... 4/541.1
4,979,245 A * 12/1990 Gandini ..... 4/541.4
5,383,239 A * 1/1995 Mathis et al. ..... 4/541.1

* cited by examiner

*Primary Examiner*—Gregory L. Huson
*Assistant Examiner*—Khoa D. Huynh

(57) ABSTRACT

A massaging tub includes a tub body, a spraying pipe, a water outlet pipe, a water pump, a circulation pipe, and a washing device. The washing device includes a connecting pipe, and a switch valve. Thus, the clean water can flow into the spraying pipe by operation of the switch valve to flush the dirt contained in the spraying pipe, so that the spraying pipe is kept clean constantly. In addition, the spraying pipe is substantially arc-shaped and is bent downward, so that the dirt contained in the spraying pipe can be flushed outward rapidly and completely.

9 Claims, 4 Drawing Sheets

MASSAGING TUB HAVING AUTOMATIC WASHING FUNCTION

BACKGROUND OF THE INVENTION

1. Field of the Invention

The present invention relates to a massaging tub, and more particularly to a massaging tub having an automatic washing function.

2. Description of the Related Art

A conventional massaging tub comprises a tub body having an inside formed with a receiving portion. The receiving portion of the tub body has a peripheral wall provided with a spraying pipe having a plurality of nozzles for injecting the water into the receiving portion of the tub body to achieve a massaging effect.

However, the dirt contained in the water is easily deposited in the nozzles of the spraying pipe during a long-term utilization, thereby causing a sanitary problem.

SUMMARY OF THE INVENTION

The primary objective of the present invention is to provide a massaging tub having an automatic washing function.

Another objective of the present invention is to provide a massaging tub, wherein the clean water can flow into the spraying pipe by operation of the switch valve to flush the dirt contained in the spraying pipe, so that the spraying pipe is kept clean constantly.

A further objective of the present invention is to provide a massaging tub, wherein the spraying pipe is substantially arc-shaped aid is bent downward, so that the dirt contained in the spraying pipe can be flushed outward rapidly and completely.

A further objective of the present invention is to provide a massaging tub, wherein the check valve can prevent the dirt contained in the spraying pipe from flowing backward through the connecting pipe into the cold water pipe (or the hot water pipe), thereby achieving a sanitary effect.

A further objective of the present invention is to provide a massaging tub, wherein the switch valve can be operated easily, rapidly and conveniently, thereby facilitating the user cleaning the spraying pipe.

In accordance with the present invention, there is provided a massaging tub, comprising:

- a tub body having an inside formed with a receiving portion having a peripheral wall provided with a spraying pipe;
- a water outlet pipe mounted on the tub body and having a first end connected to the receiving portion of the tub body;
- a water pump mounted on the tub body and having a first side connected to a second end of the water outlet pipe;
- a circulation pipe having a first end connected to a second side of the water pump and a second end connected to the spraying pipe; and
- a washing device mounted on the tub body and including:
- a connecting pipe having a first end connected to a water pipe and a second end connected to the circulation pipe; and
- a switch valve mounted on the first end of the connecting pipe and located adjacent to the water pipe.

Further benefits and advantages of the present invention will become apparent after a careful reading of the detailed description with appropriate reference to the accompanying drawings.

DETAILED DESCRIPTION OF THE INVENTION

Figure 1:
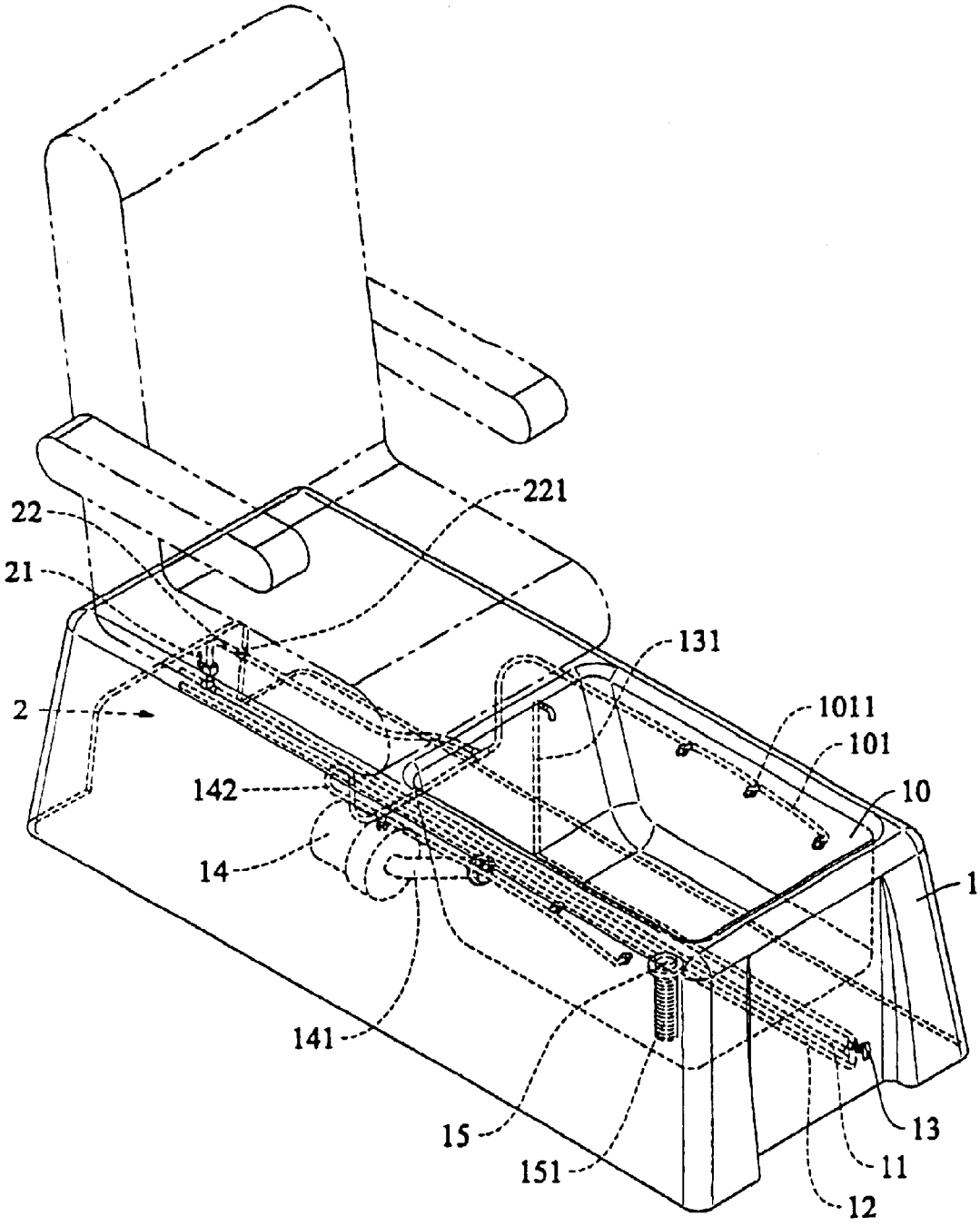
FIG. 1 is a perspective view of a massaging tub in accordance with the preferred embodiment of the present invention.
Figure 2:
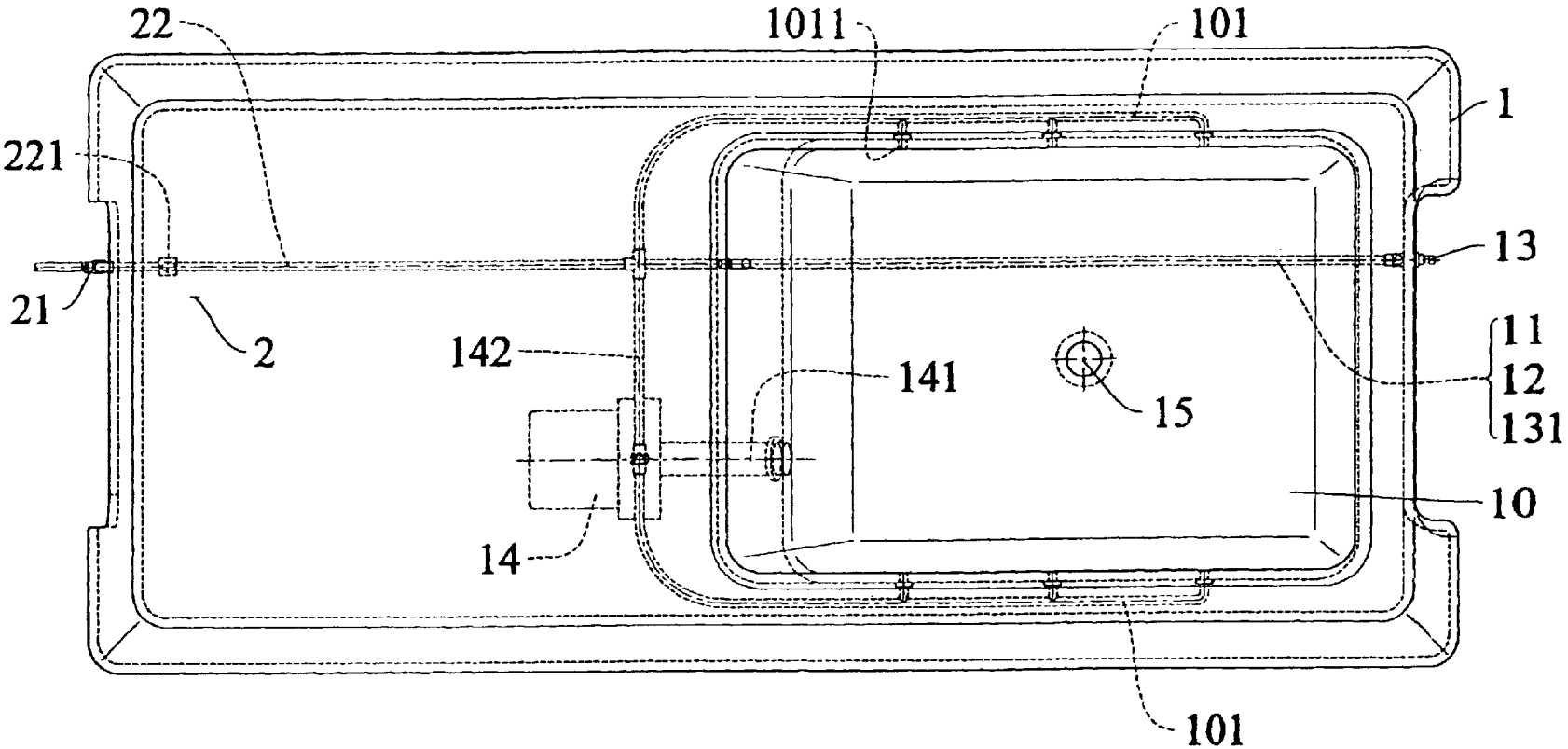
FIG. 2 is a top plan view of the massaging tub as shown in FIG. 1.
Figure 3:
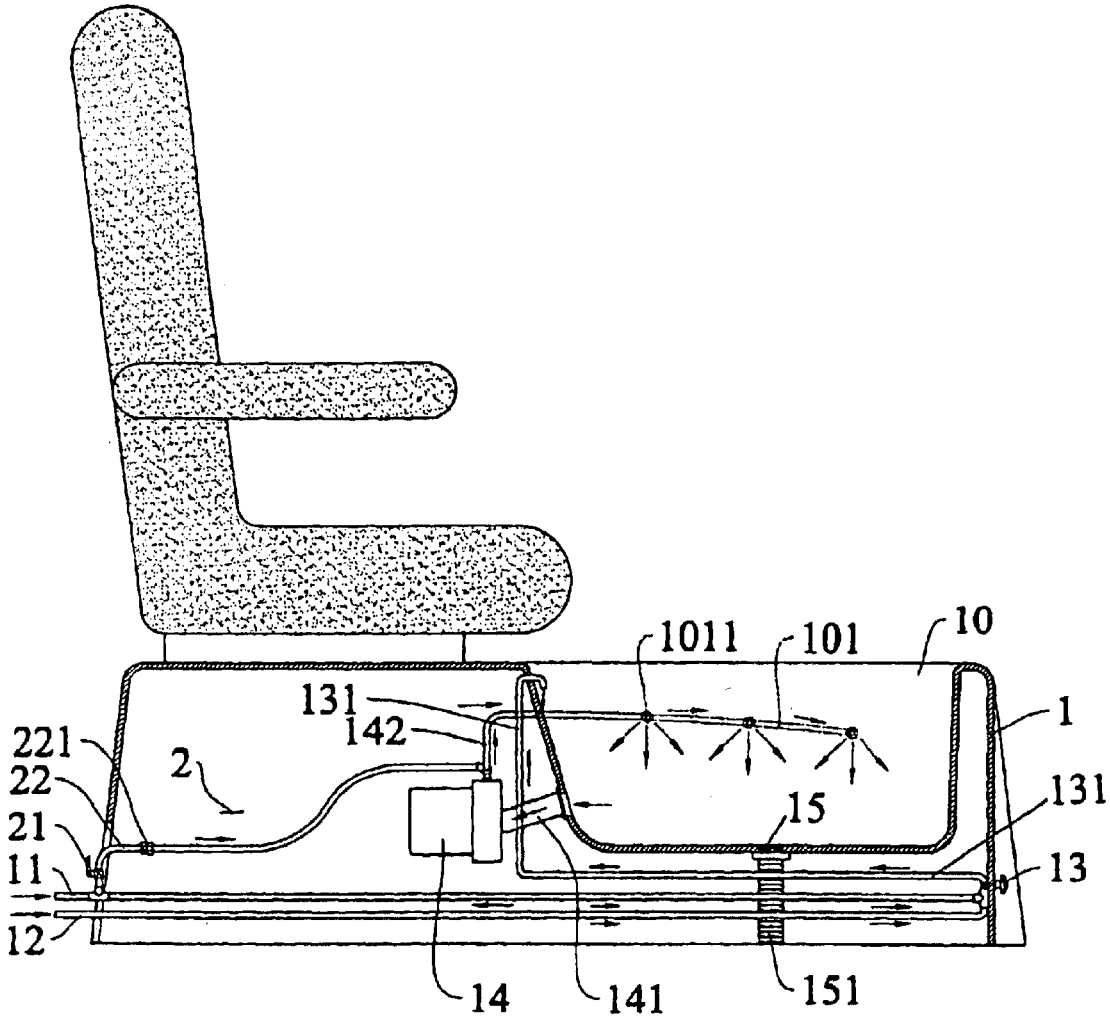
FIG. 3 is a side plan cross-sectional operational view of the massaging tub as shown in FIG. 1.

Referring to the drawings and initially to FIGS. 1–3, a massaging tub, such as a massaging bath tub, foot massaging tub or the like, in accordance with the preferred embodiment of the present invention comprises a tub body 1, and a washing device 2.

The tub body 1 has an inside formed with a receiving portion 10. The receiving portion 10 of the tub body 1 has a peripheral wall provided with a spraying pipe 101 having a plurality of nozzles 1011. Preferably, the spraying pipe 101 is substantially arc-shaped, and is bent downward.

The massaging tub further comprises a water inlet pipe 131 mounted on a bottom of the tub body 1 and having a first end extended into the receiving portion 10 of the tub body 1, a cold water pipe 11 mounted on the bottom of the tub body 1 and having a first end connected to a second end of the water inlet pipe 131, a hot water pipe 12 mounted on the bottom of the tub body 1 and having a first end connected to the second end of the water inlet pipe 131, and a switch 13 mounted on the tub body 1 and connected between the water inlet pipe 131, the cold water pipe 111 and the hot water pipe 12 to control the mixed water from the cold water pipe 11 and the hot water pipe 12 to flow into the water inlet pipe 131. In addition, the bottom of the tub body 1 is formed with a drain hole 15 which is provided with a drain pipe 151 extended into the ambient environment.

The massaging tub further comprises a water outlet pipe 141 mounted on the tub body 1 and having a first end connected to the receiving portion 10 of the tub body 1, a water pump 14 mounted on the tub body 1 and having a first side connected to a second end of the water outlet pipe 141, and a circulation pipe 142 having a first end connected to a second side of the water pump 14 and a second end connected to the spraying pipe 101.

The washing device 2 is mounted on the tub body 1 and includes a connecting pipe 22 having a first end connected to the cold water pipe 11 (or the hot water pipe 12) and a second end connected to the circulation pipe 142, a switch valve 21 mounted on the first end of the connecting pipe 22 and located adjacent to the cold water pipe 11, and a check valve 221 mounted on the connecting pipe 22 and located between the switch valve 21 and the circulation pipe 142. Preferably, the switch valve 21 is controlled by an electrical power or controlled manually.

In operation, referring to FIG. 3 with reference to FIGS. 1 and 2, the switch 13 is opened, so that the mixed water from the cold water pipe 11 and the hot water pipe 12 can flow through the water inlet pipe 131 into the receiving portion 10 of the tub body 1. Then, the water pump 14 is operated to draw the water contained in the receiving portion 10 of the tub body 1 through the water outlet pipe 141 and the circulation pipe 142 into the spraying pipe 101, so that the water can be injected from the nozzles 1011 of the spraying pipe 101 into the receiving portion 10 of the tub body 1, thereby achieving a circulation effect.

Figure 4:
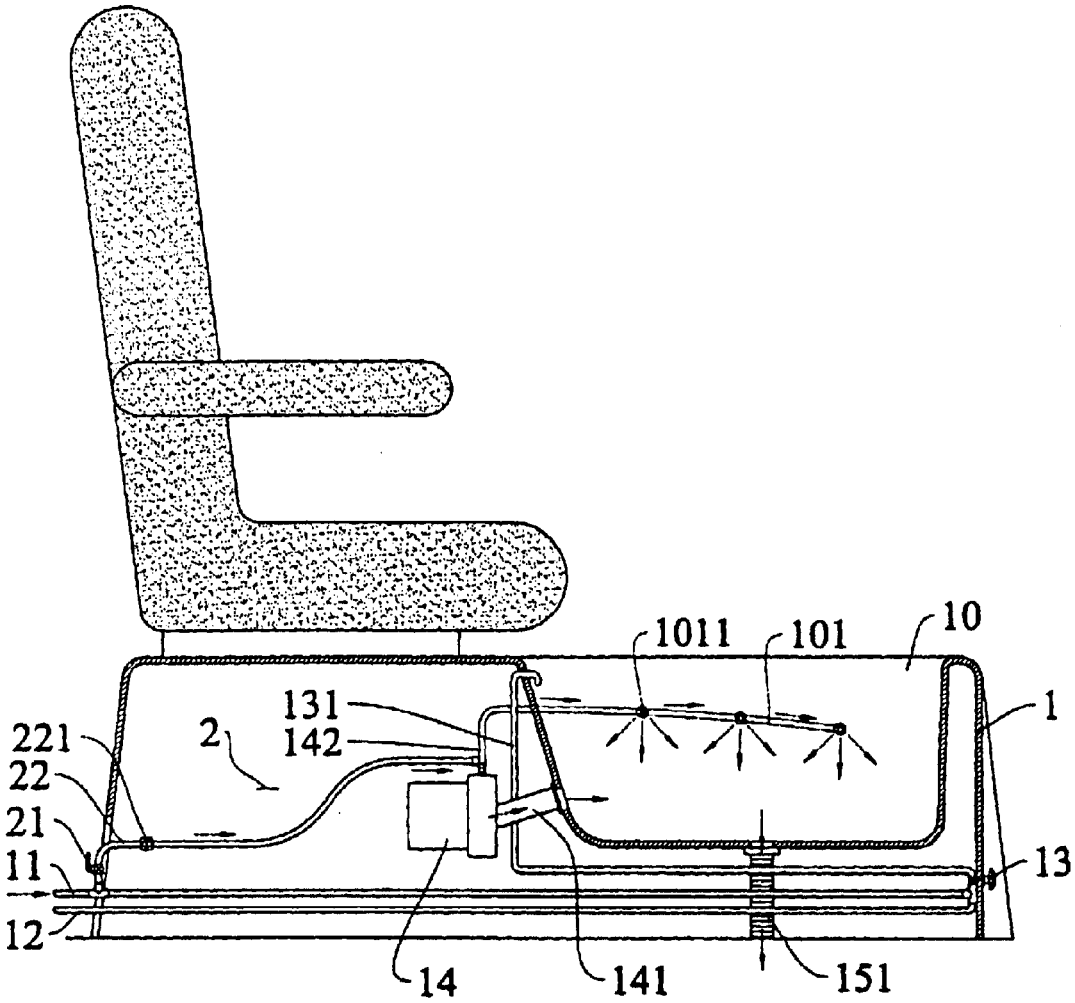
FIG. 4 is a side plan cross-sectional operational view of the massaging tub as shown in FIG. 1.

Alternatively, referring to FIG. 4 with reference to FIGS. 1 and 2, the switch 13 is closed, and the switch valve 21 is opened, so that the clean water from the cold water pipe 11 (or the hot water pipe 12) can flow through the connecting pipe 22 and the circulation pipe 142 into the spraying pipe 101, so that the dirt contained in the spraying pipe 101 can be flushed outward from the nozzles 1011 of the spraying pipe 101 into the receiving portion 10 of the tub body 1, and can then be drained outward from the drain hole 15 and the drain pipe 151.

Accordingly, the massaging tub has the following advantages.

1. The clean water can flow into the spraying pipe 101 by operation of the switch valve 21 to flush the dirt contained in the spraying pipe 101, so that the spraying pipe 101 is kept clean constantly.
2. The spraying pipe 101 is substantially arc-shaped and is bent downward, so that the dirt contained in the spraying pipe 101 can be flushed outward rapidly and completely.
3. The check valve 221 can prevent the dirt contained in the spraying pipe 101 from flowing backward through the connecting pipe 22 into the cold water pipe 11 (or the hot water pipe 12), thereby achieving a sanitary effect.
4. The switch valve 21 can be operated easily and conveniently, thereby facilitating the user cleaning the spraying pipe 101.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A massaging tub, comprising:

a tub body having an inside formed with a receiving portion having a peripheral wall provided with a spraying pipe;

a water outlet pipe mounted on the tub body and having a first end connected to the receiving portion of the tub body;

a water pump mounted on the tub body and having a first side connected to a second end of the water outlet pipe;

a circulation pipe having a first end connected to a second side of the water pump and a second end connected to the spraying pipe;

a washing device mounted on the tub body and including: a connecting pipe having a first end connected to a water pipe and a second end connected to the circulation pipe; and a switch valve mounted on the first end of the connecting pipe and located adjacent to the water pipe;

a water inlet pipe mounted on a bottom of the tub body and having a first end extended into the receiving portion of the tub bode, wherein the water pipe has an end connected to a second end of the water inlet pipe; and a switch mounted on the tub body and connected between the water inlet pipe and the water pipe.

2. The massaging tub in accordance with claim 1, wherein the spraying pipe is substantially arc-shaped.

3. The massaging tub in accordance with claim 1, wherein the spraying pipe is bent downward.

4. The massaging tub in accordance with claim 1, wherein the spraying pipe has a plurality of nozzles.

5. The massaging tub in accordance with claim 1, wherein the washing device further includes a check valve mounted on the connecting pipe and located between the switch valve and the circulation pipe.

6. The massaging tub in accordance with claim 1, wherein the water pipe is a cold water pipe.

7. The massaging tub in accordance with claim 1, wherein the water pipe is a hot water pipe.

8. The massaging tub in accordance with claim 1, wherein the switch valve is controlled by an electrical power.

9. The massaging tub in accordance with claim 1, wherein the switch valve is controlled manually.

* * * * *